United States Patent [19]

Johannson

[11] 4,095,677

[45] Jun. 20, 1978

[54] HOISTING APPARATUS

[76] Inventor: Hans A. V. Johannson, Trehäradsvägen, Eslöv, Sweden, 5241 00

[21] Appl. No.: 665,296

[22] Filed: Mar. 9, 1976

[51] Int. Cl.[2] ..... B66B 9/04

[52] U.S. Cl. ..... 187/17; 187/1 R; 187/95

[58] Field of Search ..... 187/9 R, 17, 95, 24, 187/25

[56] References Cited

U.S. PATENT DOCUMENTS

| | | | |
|---|---|---|---|
| 783,699 | 2/1905 | Laffin | 187/9 R |
| 1,563,792 | 12/1925 | Rickard | 187/24 |
| 2,732,087 | 1/1956 | Pratt | 187/9 R |

*Primary Examiner*—Bruce H. Stoner, Jr.
*Assistant Examiner*—Jeffrey V. Nase
*Attorney, Agent, or Firm*—John J. Dennemeyer

[57] ABSTRACT

A hoisting apparatus for lifting an object, a pressure cylinder and piston unit whose piston is secured to a connecting device fixed to the object to be lifted by a coupling device provided with guide sleeves mounted for vertical sliding movement on upright support posts for the connecting device and disposed adjacent the cylinder and piston unit.

4 Claims, 10 Drawing Figures

HOISTING APPARATUS

The present invention relates to a hoisting apparatus for hoisting or lifting an object, such as a bath tub, which is operatively connected to at least one fixedly mounted power actuator, for example a pressure-cylinder and piston device, through a coupling or carrier unit cooperating with at least one fixedly mounted guide member.

In hoisting apparatus of the type mentioned above a problem is frequently encountered which resides in that under high-load conditions movable parts tend to cant relative to adjacent fixed parts, accompanied by the risk of wedging of the movable parts. Particularly where the hoisting apparatus is intended to carry out extensive lifting movements, the wedging problem may become serious so that the risk of substantial deformations or breakages of load-carrying parts cannot be excluded.

Efforts made with a view to solve the guiding function in hoisting apparatus have resulted in complex and, first and foremost, heavy, unwieldy and expensive constructions.

It is an object of the present invention to eliminate these drawbacks and to provide a hoisting apparatus which is extremely simple, stable and well-functioning, while eliminating at the same time any tendencies of wedging. This result, according to the invention, is substantially accomplished by the fact that the hoisting apparatus comprises at least one guiding sleeve forming part of the coupling unit and being positively guided to move along the guide member by embracing the latter, the guiding sleeve being arranged on the one hand to control at least one device connecting the connecting unit with the power actuator, and on the other hand to control at least one connecting member forming part of the connecting unit.

The invention will be described in greater detail hereinafter with reference to the accompanying drawings, in which.

Figure 1:
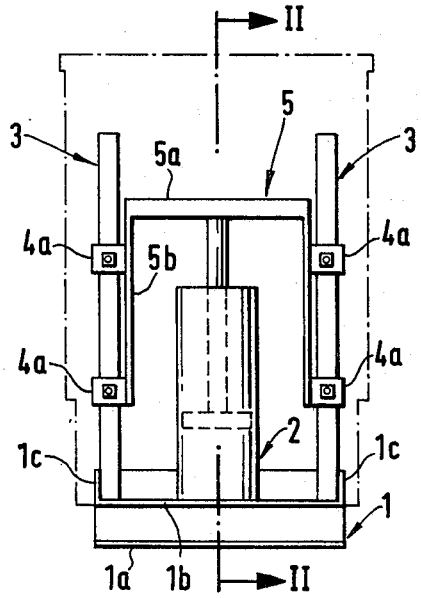
FIG. 1 is a front view of the hoisting apparatus according to the invention.
Figure 2:
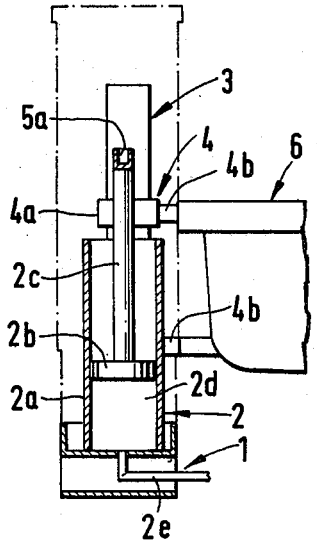
FIG. 2 is a view in cross section taken along line II — II in FIG. 1.
Figure 4:
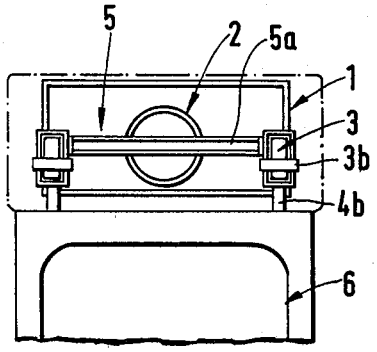
FIG. 4 is a plan view of the hoisting apparatus.
Figure 3:
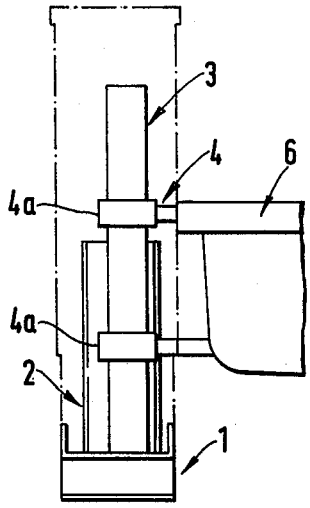
FIG. 3 is a side elevational view of the hoisting apparatus.
Figure 5:
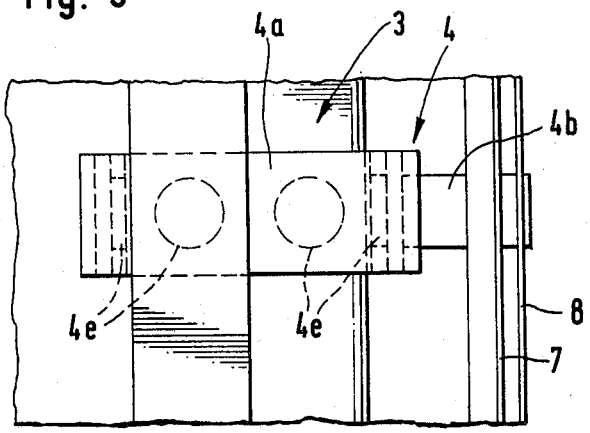
FIG. 5 is an enlarged side view of a portion of the apparatus.
Figure 6:
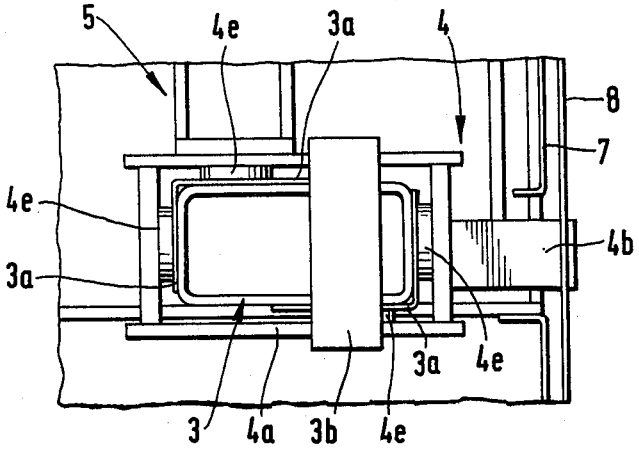
FIG. 6 is a plan view of the portion illustrated in FIG. 5.
Figure 8:
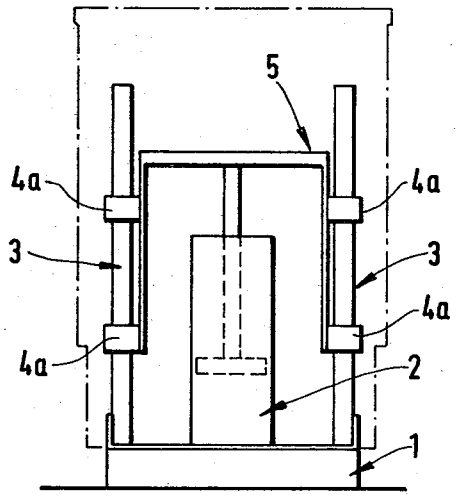
FIG. 8 is a rear end view of the hoisting apparatus.
Figure 7:
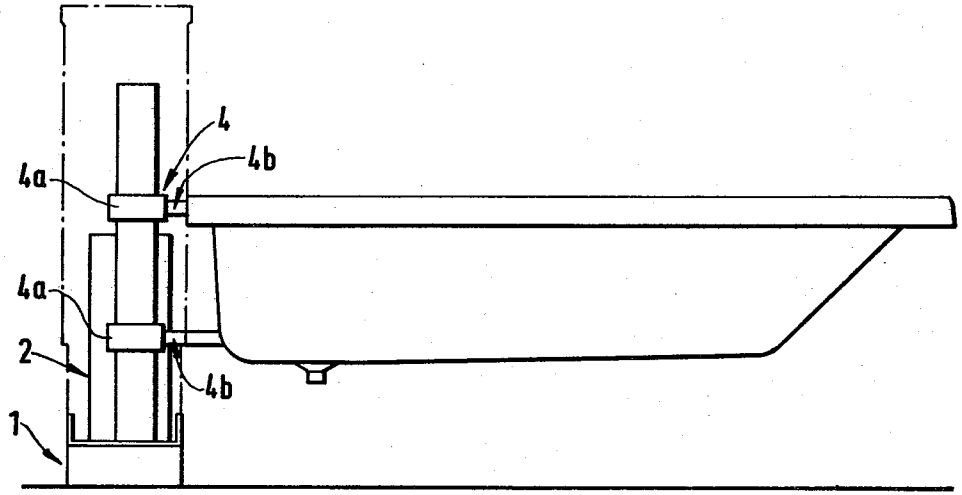
FIG. 7 is a side view of the hoisting apparatus.
Figure 9:
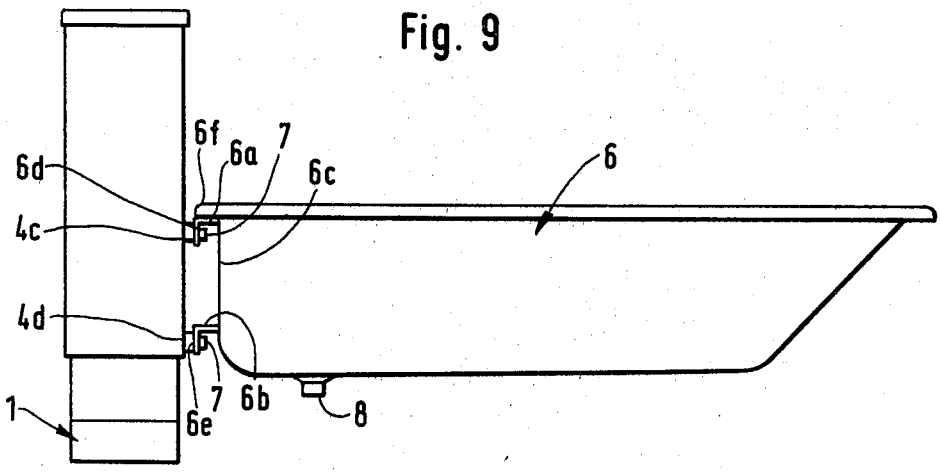
FIG. 9 is a side view of the hoisting apparatus and illustrates the mounting arrangement according to the invention.
Figure 10:
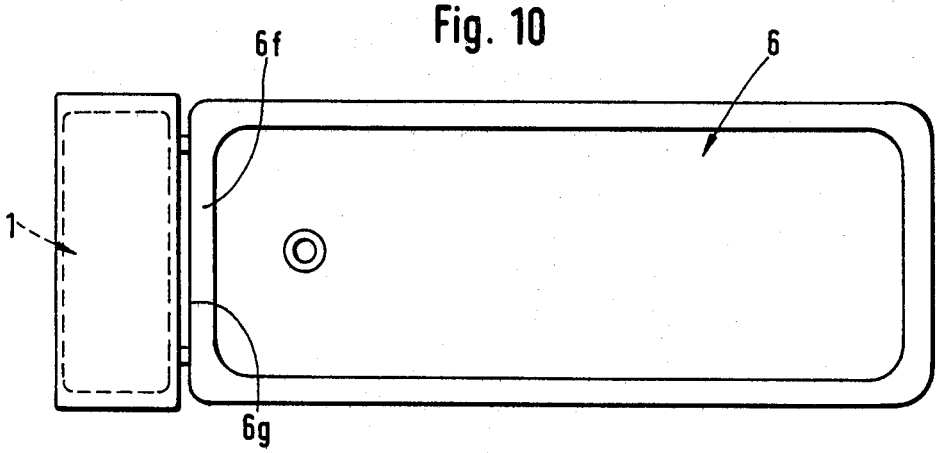
FIG. 10 is a plan view of the hoisting apparatus.

The hoisting apparatus illustrated in the drawings is intended to be used for hoisting or lifting an object or load disposed alongside the apparatus. The principal components of the hoisting apparatus are a frame 1, at least one power actuator 2 mounted on the frame 1, guide means disposed on the frame 1 and including at least one guide member 3, a coupling unit 4 cooperating with the guide member 3 and carrying the object to be lifted, for instance a bath tub 6, and a connecting device 5 connecting the power actuator unit 1 with the coupling unit 4.

The frame 1 illustrated in the drawings is intended to be cast into a floor for stationary installation. The frame 1 in principle, is boxlike in structure and comprises a base plate 1*a* adapted to be cast into the floor, while an upper portion 1*b* forming the top of the frame is adapted to lie flush with the floor surface. Projecting upward from the upper frame portion 1*b* are side flanges 1*c* serving as reinforcements for the frame and, in addition, as mounting flanges for the guide members 3. As an alternative to a stationary, cast-in-frame, it would be possible, of course to use a frame that is free-standing on the floor (not illustrated) for carrying the hoisting apparatus.

As power actuator 2 a device is preferably used which comprises a pressure cylinder 2*a* and a piston 2*b* displaceable therein and having a piston rod 2*c* projecting upwardly from the cylinder 2*a*. In order to obtain a water-driven (so-called water-hydraulic) power actuator, the chamber 2*d* for receiving the operating fluid of the cylinder 2*a* may be connected to the domestic water mains or to a separate pump. As alternatives to water-driven power actuators, electro-mechanical or electro-hydraulical devices may be employed.

In order to obtain a simple and stable design of this hoisting apparatus and to avoid any risk of wedging of movable parts, according to the present invention, at least one guide sleeve 4*a* forming part of the coupling unit 4 is positively controlled to move along the guide member 3 by embracing the same, this guide sleeve 4*a* being adapted on the one hand to control the connecting device 5 for connecting the coupling unit 4 with the power actuator 2, and on the other hand to control at least one coupling member 4*b* forming part of the unit 4. One of the coupling members 4*b* is mounted on the front side of each of the guide sleeves 4*a*, as is clearly shown in the drawings.

To ensure a stable and positive connection between the power actuator 2 and the coupling members 4*b* of the coupling unit 4, the connecting device 5 and the coupling members 4*b* are both individually mounted on the guide sleeve 4*a*, that is to say the guide sleeve 4*a* interconnects the connecting device 5 with the coupling members 4*b*. The combination of the connecting device 5 with the coupling unit 4 will be especially stable if, as seen in plan view, the guide sleeve 4*a* forms a corner piece between a portion 5*a* of the connecting device 5 and the coupling members 4*b*. An advantageous symmetry of load transmission will be obtained in particular if the coupling member 4*b* projects from the front side of its associated guide sleeve 4*a* in such a way that an imaginary extension of the coupling members 4*b* would intersect the guide members or column 3. In this connection it would be advantageous to connect the coupling device 5 to the guide sleeve 4*a* in a manner to cause an imaginary extension of the portion 5*a* to intersect the guide column 3. As is seen from the drawings, the vertical elements 5*a* of the device 5 are secured to the inner portions of their associated guide sleeves 4*a*.

In order to provide a ridig and positive guide member 3 and guide sleeve 4*a* without any necessity of over-dimensioning these parts, the guide member 3 may be designed with a four-sided, preferably rectangular, tubular cross-section, and the guide sleeve may be a four-sided, preferably rectangular part. The guide member 3 preferably includes sheet-metal angular corner plates 3*a* made, for example, of stainless steel and formed with sliding surfaces, and the guide sleeve 4*a* cooperates with these corner plates 3*a* through the intermediary of bearing elements 4*e* made, for example, of plastic material. The corner plates 3*a* and bearing elements 4*e* enable sliding movement of the guide sleeve 4*a*, prevent binding through any formation of rust and in addition enable a well-guided sliding of the guide sleeve 4*a* along the guide member 3.

In the embodiment shown the hoisting apparatus is particularly well balanced for loads by the power actuator 2 carried between the guide members 3 so that the guide sleeves 4*a* are rigidly connected with each other by the member 5*a* of the coupling device 5 disposed between the guide members 3. As seen from the drawings, the member 5*a* in turn is secured to the lifting part of the power actuator 2, i.e. to the piston rod 2*c*.

As an additional stabilizing factor the guide columns 3 may have their outwardly facing sides welded into the inwardly facing sides of the frame flanges 1*c*, which would enable the guide members to take up high bending stress in the forward direction.

The hoisting apparatus according to the invention is adapted to carry a plurality of coupling members 4*b*, which is possible due to the expedient that each member 5*b* forming part of the coupling device 5 and extending vertically inwardly of the guide members 3 forms a carrier for at least two vertically aligned guide sleeves 4*a* having coupling members 4*b*. Due to the side-by-side arrangement of the power actuator 2, guide members 3 and coupling device 5, a very rigid "power pack" for lifting substantial loads is obtained.

It is possible, within the scope of the appended claims, to vary the number of elements from which the hoisting apparatus is assembled, and also to vary the design of elements forming part thereof. Thus, for example, although at least one guide member or column 3 is required, it would be possible to employ two, three or more guide members. To limit the lifting stroke, the guide column 3 may be provided with a stop abutment 3*b* at its top end. Furthermore, the number of guide sleeves can be varied too, as well as the number of coupling devices 4*b*. To conceal or protect the hoisting apparatus it may be placed in a casing 7 carried by the frame, and outside this casing 7 a panel 8 may be disposed which is mounted in the guide sleeves 4*a* and is intended to carry various articles of equipment, such as any required sanitary equipment.

The hoisting apparatus and the object to be lifted present a mounting arrangement which, according to the invention, substantially comprises at least one, preferably two, upper coupling elements 4*c* for taking up tensile stresses and at least one, preferably two, lower coupling elements 4*d* for taking up compressive stresses. Furthermore the bath tub 6 comprises at least one fitting 6*a* cooperating with the upper coupling element 4*c* and at least one support 6*b* cooperating with the lower coupling element 4*d*. The coupling elements 4*c*, 4*d* and associated fitting 6*a* and support 6*b* on the one hand are entirely disposed between the power unit and the side 6*c* of the bath tub 6 facing the power unit, and on the other hand, are designed as interconnectible coupling devices which carry the bath tub 6 as a cantilever supported unit adjacent the hoisting apparatus.

The advantages of this arrangement reside in the first place in the obtainment of a very simplified and stable construction which, due to its simple design, will substantially reduce the manufacturing cost compared to prior art arrangements of a corresponding type. Furthermore the interior of the bath tub 6 and/or the occupant of the bath tub will become more easily accessible since three of the bath tub sides are completely free from connecting arrangements. This will also involve increased possibilities of utilizing a transfer device for transferring patients into and out of the bath tub 6. In addition, the entire equipment can easily be kept neat and clean, a factor of particular importance when the equipment is to be used in sanitary installations. Since both hoisting gear and bath tub 6 are devoid of lengthy carrier arms projecting therefrom, the mounting and assembly operation is simple, and the units will not be bulky and unwieldy during transportation and internal handling thereof.

In order to provide a particularly safe and also simple mounting arrangement, the upper coupling element 4*c*, at least, may include a coupling plate (not shown) and the fitting 6*a* may include a coupling plate 6*d* (the support 6*b* may include a coupling plate 6*e* cooperating with the lower coupling element 4*d*), the coupling plates being interconnected by bolts 7 or the like.

In order to obtain a positive attachment of the fittings 6*a* to the bath tub 6, these fittings are attached on the one hand to the outer surfaces of the bath tub wall, and on the other hand to the underside of a flange 6*f* projecting from the top-edge of the bath tub wall.

To make the bath tub 6 less unwieldy during transportation and also easily attachable to the hoisting apparatus, the fitting 6*a* and support 6*b* may be disposed entirely inwardly of a vertical plane extending through the edge 6*g* of the projecting flange 6*f* so that the engagement surfaces of the fitting 6*a* and support 6*b* will lie substantially in this vertical plane.

The region of attachment between fitting/support and bath tub 6 will be very rigid if each fitting 6*a* and/or support 6*b* is connected to a reinforcement (not shown) extending along and attached to a portion of the side 6*c* of the bath tub 6 facing the hoisting apparatus and also along and attached to a portion of another side of the bath tub 6.

As will be seen from the arrangement illustrated in the drawings the inventive arrangement includes two upper coupling elements and fittings cooperating therewith, and two lower coupling or supporting elements and supports cooperating therewith. The upper coupling elements and fittings are interconnected by being screwed or hooked together. The lower coupling elements and supports may be interconnected in a similar way, but it is simpler and frequently enough to let the supports rest on the lower coupling elements.

In addition to the inventive arrangement here described and its advantages, structural modifications and features not illustrated are possible within the scope of the appended claims. In connection with the arrangement here described, it may be mentioned that the bath tub outlet 8 may be connected to a spirally coiled discharge hose (not shown) whose terminal end is immersed into a drain gutter (not shown). This will ensure a non-splashing discharge of the bath tub 6 even when the tub is disposed at a high level above the floor.

What is claimed is:

1. A hoisting apparatus for hoisting or lifting an object disposed beside the apparatus, and including: a frame; two substantially vertical guide members fixedly mounted on the frame in spaced, parallel relationship; a vertically extendable power actuator device mounted on said frame between said guide members, and including a vertically movable shaft; at least two guide sleeves slidably received on and encircling each guide member, said guide sleeves being positively guided for movement along their respective guide members and being spaced vertically apart; a coupling member carried by each guide sleeve on the front side thereof for coupling to the object to be hoisted or lifted; a pair of vertical elements, one secured to the inner portion of the guide sleeves on each guide member; and a bridging element connecting the upper end portions of said vertical elements and extending horizontally therebetween, said vertical elements and said bridging element lying generally in a plane passing through the longitudinal axes of said vertical guide members, the guide sleeves on one guide member being positioned opposite and at the same level as the corresponding guide sleeves on the other guide member, and said bridging element being connected with the upper end of said shaft.

2. A hoisting apparatus as recited in claim 1, wherein said power actuator device is a hydraulic cylinder.

3. A hoisting apparatus as recited in claim 1, wherein said guide members have a rectangular cross-section, and said guide sleeves have a corresponding rectangular cross-section.

4. A hoisting apparatus as recited in claim 3, wherein said rectangular guide members are provided with corner pieces forming sliding surfaces, and wherein said guide sleeves carry bearing elements on the interior thereof arranged to slidingly engage said corner pieces.

* * * * *